US006484658B1

(12) United States Patent
Aaness

(10) Patent No.: US 6,484,658 B1
(45) Date of Patent: Nov. 26, 2002

(54) LOADING ARRANGEMENT FOR SHUTTLE TANKERS

(75) Inventor: Lars Aaness, Arendal (NO)

(73) Assignee: Maritime Pusnes AS, Faervik (NO)

( * ) Notice: Subject to any disclaimer, the term of this patent is extended or adjusted under 35 U.S.C. 154(b) by 0 days.

(21) Appl. No.: 09/720,797

(22) PCT Filed: Jun. 30, 1999

(86) PCT No.: PCT/NO99/00221

§ 371 (c)(1),
(2), (4) Date: Feb. 26, 2001

(87) PCT Pub. No.: WO00/02773

PCT Pub. Date: Jan. 20, 2000

(30) Foreign Application Priority Data

Jun. 30, 1998 (NO) ..... 19983038

(51) Int. Cl.[7] ..... B63B 21/00
(52) U.S. Cl. ..... 114/230.1; 414/137.7
(58) Field of Search ..... 114/230.1, 230.2–230.26; 254/266, 278, 288, 289, 293, 294; 414/137.7

(56) References Cited

U.S. PATENT DOCUMENTS 1,940,051 A * 12/1933 Heath ..... 254/293
4,867,211 A * 9/1989 Dodge et al. ..... 141/279
5,064,329 A * 11/1991 Brenna ..... 414/137.7

FOREIGN PATENT DOCUMENTS

GB 1514713 6/1978
GB 2250253 A 6/1992

* cited by examiner

*Primary Examiner*—Ed Swinehart
(74) *Attorney, Agent, or Firm*—Thomas Schneck

(57) ABSTRACT

A bow loading arrangement for shuttle tankers where the mooring winch drum and hose handling winch drum are operated both together and independently of each other by the same drive unit. The winch may be placed on the main deck, and by using guide pulleys both the hose handling rope and the mooring hawser can be guided to the respective drums.

4 Claims, 6 Drawing Sheets

LOADING ARRANGEMENT FOR SHUTTLE TANKERS

FIELD OF THE INVENTION

The invention is used on shuttle tankers, either on the bow or on the poop, for handling a mooring hawser and loading hose.

BACKGROUND ART

On traditional shuttle tankers the bow loading system is arranged so that the mooring winch is placed on the platform deck of the ship in its center line. A chain stopper and a fairlead are placed in front of the winch. The hose is pulled on board by means of a separate hose handling winch placed on the main deck in the center line of the ship. This solution requires the platform deck to have large dimensions due to the necessary structure underneath the mooring winch.

SUMMARY OF THE INVENTION

By modifying the mooring winch to include an extra drum for hose handling, the entire coupling procedure can be performed by one and the same winch. Through the use of guide pulleys the mooring winch can be placed on the main deck, an arrangement having several advantages. For instance, the size of the platform deck can be reduced, and the forces that occur can be absorbed in a simple manner due to the structure already present in the main deck.

This is obtained by extending a shaft out of the drive unit of the mooring winch and placing the hose handling drum thereon. Thus, the hose handling drum as well as the mooring drum are driven by the same drive unit, but may be operated independently of each other since it is possible to uncouple them from the drive unit. The combined winch is placed on the main deck with the hose handling drum in the center line of the ship. This means that the mooring drum will be located to the side of the center line of the ship. When pulling in of the mooring hawser, the hawser is guided through the fairlead and chain stopper. A horizontal guide pulley is placed behind the chain stopper in order to guide the hawser out from the center line of the ship. Next, the hawser is guided down to the mooring drum by means of a vertical guide pulley. After completion of the mooring operation, this part is uncoupled from the drive unit and the hose handling drum is connected in order to pull in the loading hose.

DETAILED DESCRIPTION OF THE INVENTION

Figure 1:
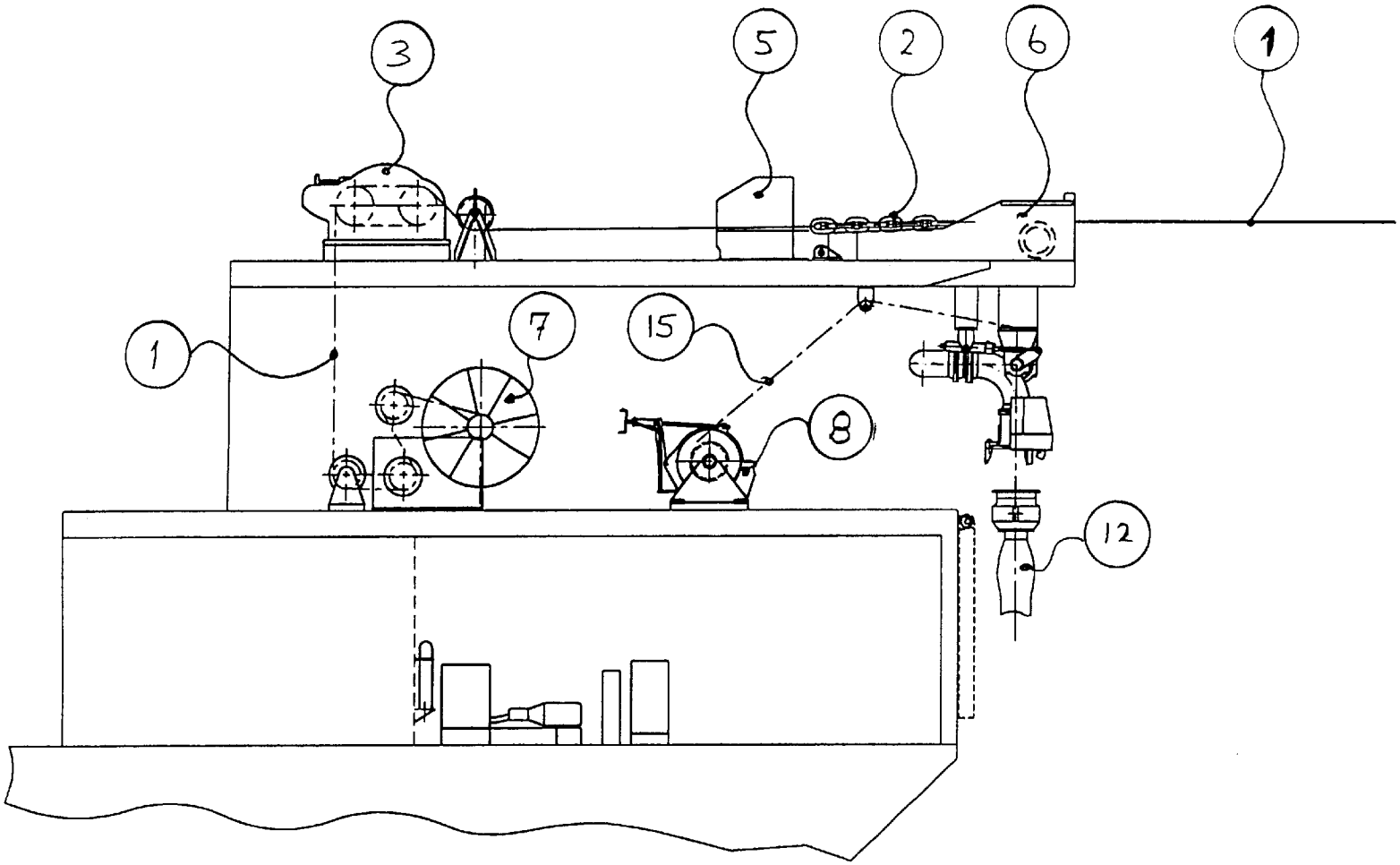
Fig. 1 (PRIOR ART)
FIGS. 1, 2 and 3 show the prior art. The mooring hawser 1 is pulled from the mooring winch 3 through the fairlead 6 and chain stopper 5, all of which are placed on the platform deck. Next, the mooring hawser 1 is guided via the mooring winch 3 down to the main deck to a storage winch 7. The mooring procedure is completed when the chain stopper 5 is locked to the wear chain 2 of the mooring hawser. Then the loading hose 12 is pulled on board by means of the hose handling winch 8 and hose handling rope 15.
Figure 2:
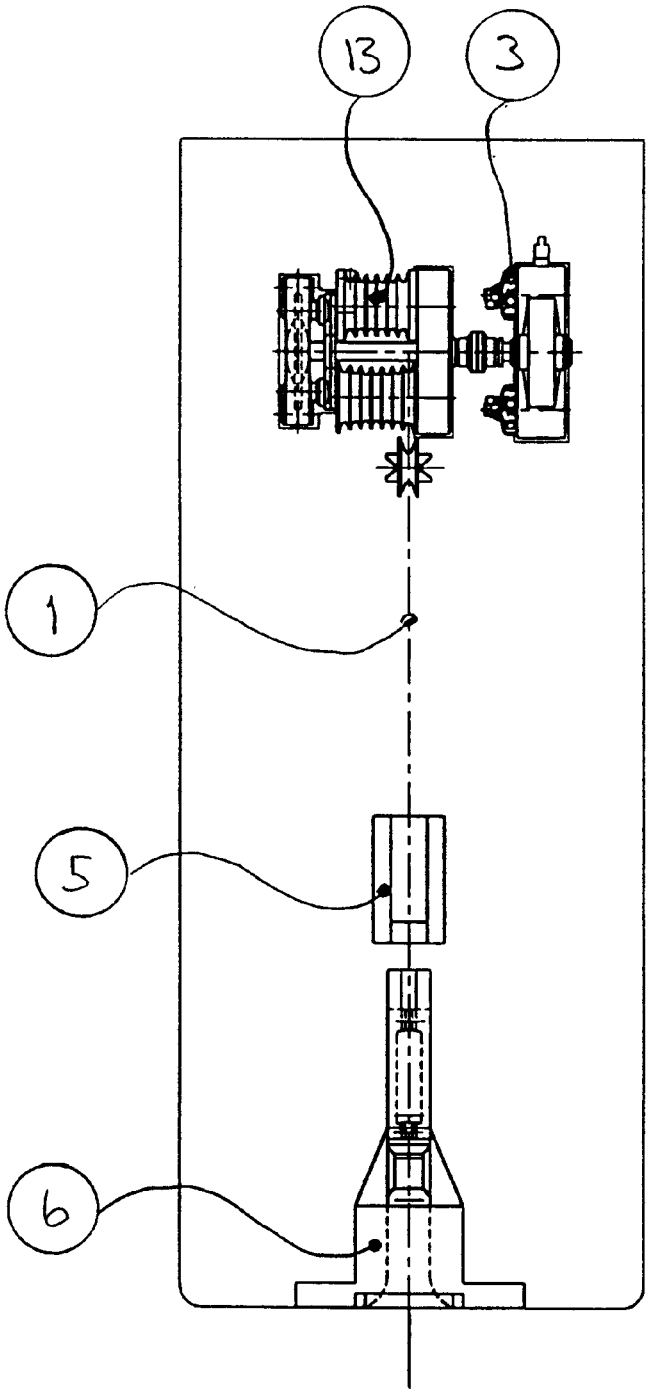
Fig. 2 (PRIOR ART)
Figure 3:
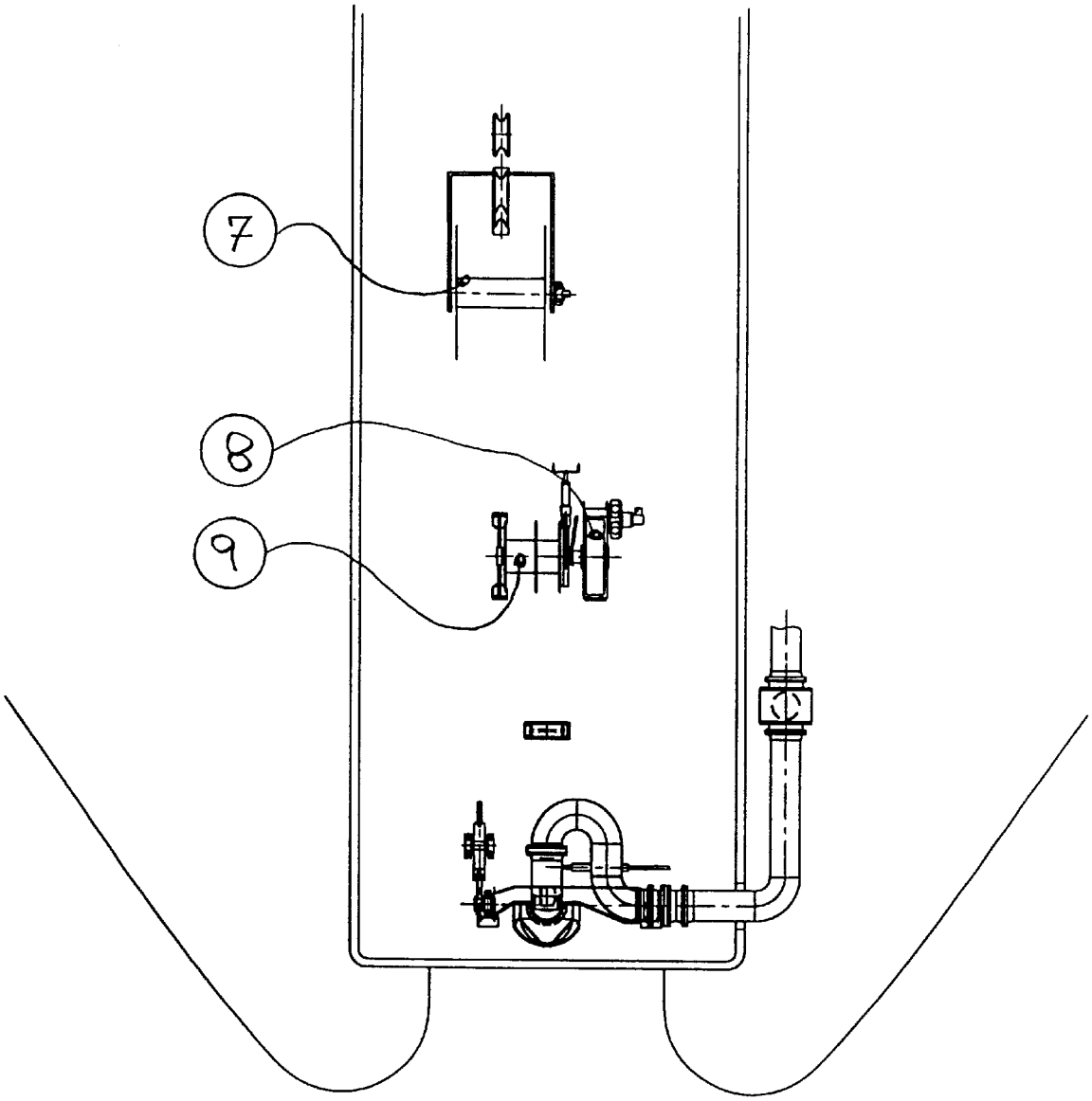
Fig. 3 (PRIOR ART)
Figure 4:
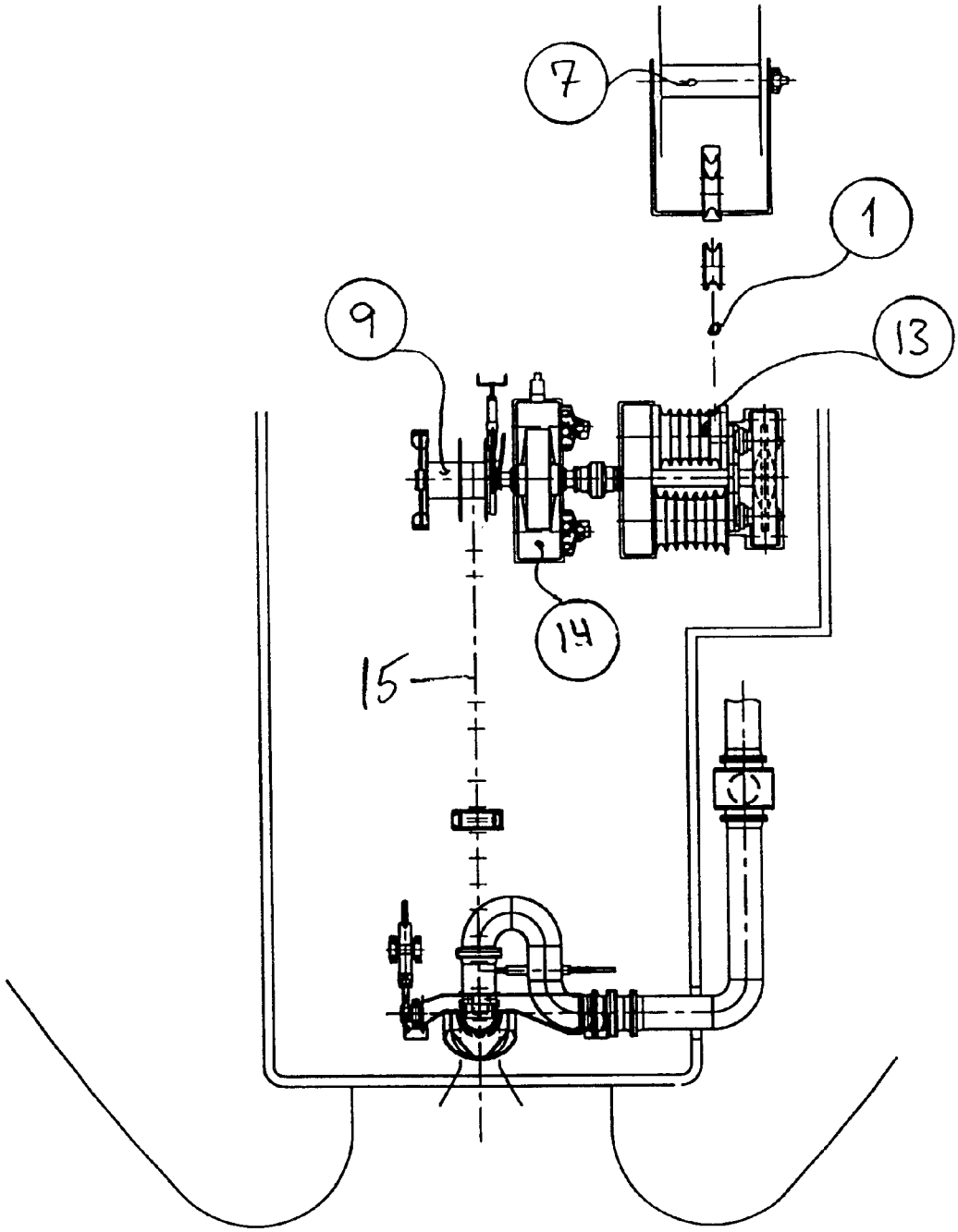
FIG. 4 shows the new arrangement on the main deck, including the mooring winch drum 13 and hose handling drum 9 coupled to the same drive unit 14.
Figure 5:
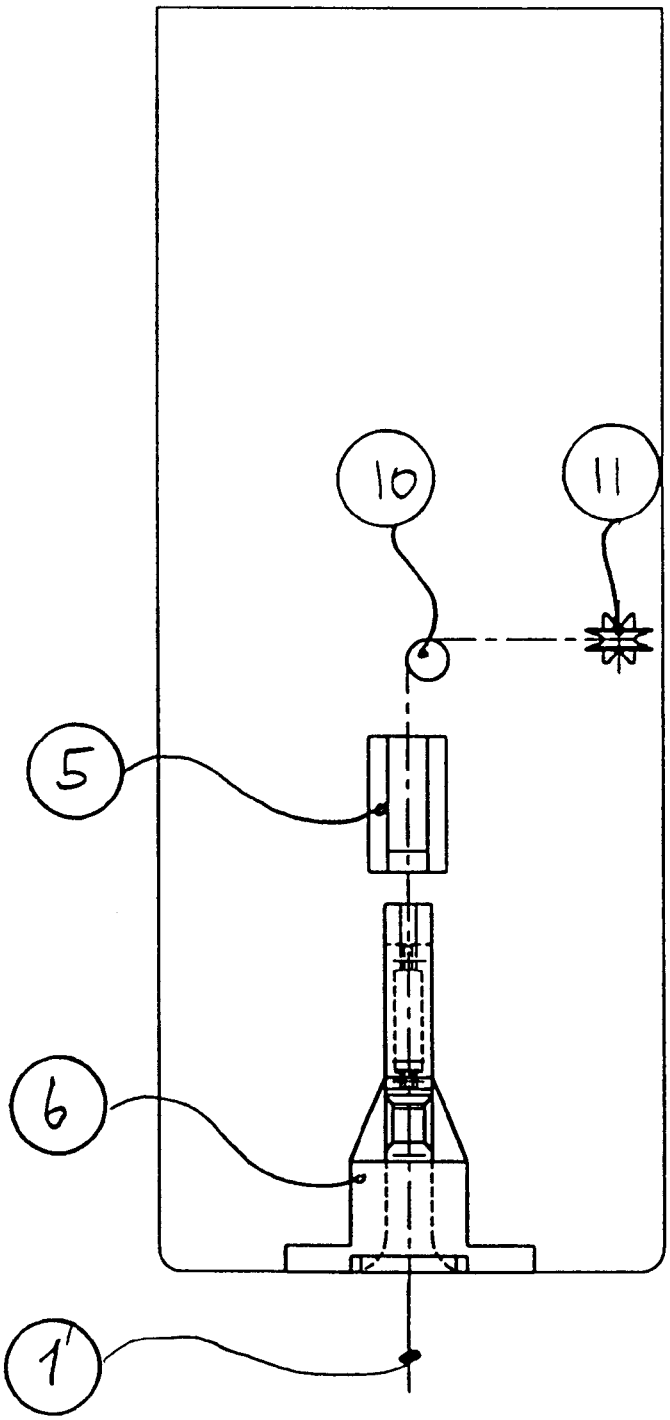
FIG. 5 shows the platform deck with fairlead 6, chain stopper 5, horizontal guide pulley 10 and vertical guide pulley 11.
Figure 6:
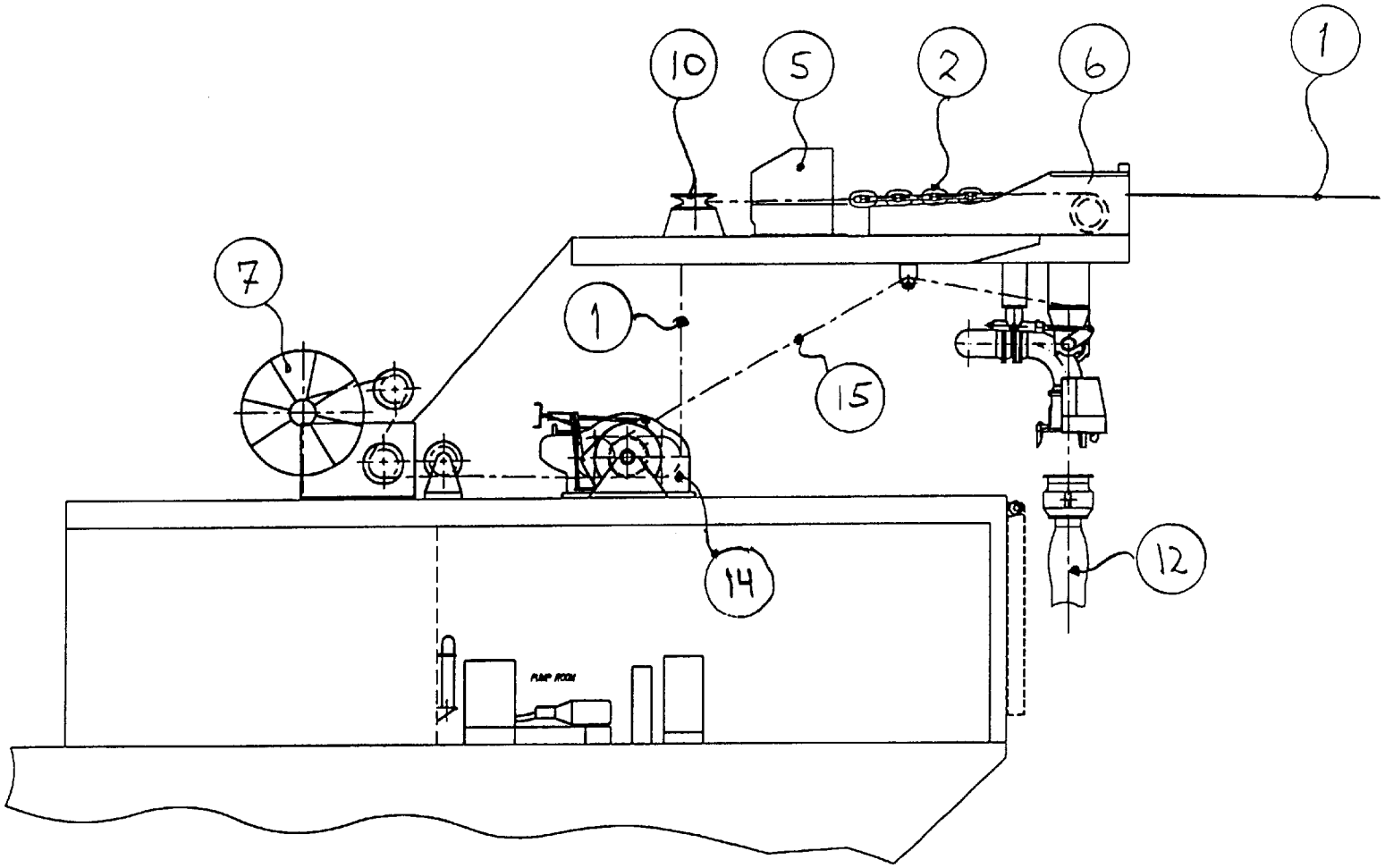
FIG. 6 shows a side view of the platform deck and main deck.

The mooring hawser is pulled from the mooring winch drum 13 through the fairlead 6 and chain stopper 5, via a horizontal guide pulley 10 and a vertical guide pulley 11, and down to the mooring winch drum 13. From there the mooring hawser is led to the storage winch 7.

The mooring procedure is terminated in the usual way. The mooring winch drum 13 is uncoupled from the drive unit 14 and the hose handling winch drum 9 is connected so as to be driven by the drive unit 14. Next, the loading hose 12 is pulled in by means of the hose handling drum 9 and the hose handling rope 15.

What is claimed is:

1. A loading arrangement for shuttle tankers having a main deck and a platform deck above the main deck, comprising a mooring winch drum (13) for a mooring hawser (1) and a hose handling winch drum (9) for a hose handling rope (15) wherein the mooring hawser (1) and the hose handling rope (15) are arranged to be pulled in on the platform deck and the main deck, respectively, and wherein the mooring winch drum (13) and the hose handling winch drum (9) are arranged for installation on one and the same of said decks and have a common drive unit (14) to which they can be coupled or uncoupled independently of each other.

2. A loading arrangement according to claim 1, wherein the mooring winch drum (13), the hose handling winch drum (9) and the drive unit (14) are arranged to be placed on the main deck with the hose handling winch drum (9) in the center line of the ship, guide pulleys (10, 11) guiding the mooring hawser (1) to the mooring winch drum (13).

3. A loading arrangement according to claim 1, wherein the mooring winch drum (13), the hose handling winch drum (9) and the drive unit (14) are arranged to be placed on the main deck with the mooring winch drum (13) in the center line of the ship, guide pulleys guiding the hose handling rope (15) to the hose handling winch drum (9).

4. A loading arrangement according to claim 1, wherein the mooring winch drum (13), the hose handling winch drum (9) and the drive unit (14) are arranged for placement on the main deck, guide pulleys guiding the hose handling rope (15) to the hose handling winch drum (9) and the mooring hawser (1) to the mooring winch drum (13).

* * * * *